United States Patent [19]

White

[11] Patent Number: 4,991,727

[45] Date of Patent: Feb. 12, 1991

[54] DRAWHEAD ALIGNMENT DEVICE

[76] Inventor: Leonard T. White, Rte. 4, Box 792, Calahan, Fla. 32011

[21] Appl. No.: 391,970

[22] Filed: Aug. 10, 1989

[51] Int. Cl.[5] ..... B61G 7/12

[52] U.S. Cl. ..... 213/20; 213/1 R; 81/176.2; 81/488

[58] Field of Search ..... 213/1 R, 12, 15, 16, 213/17, 19, 20, 75 R, 77, 100 R, 115, 162, 167; 81/176.15, 176.2, 488

[56] References Cited

U.S. PATENT DOCUMENTS

| | | | |
|---|---|---|---|
| 706,273 | 8/1902 | Stillwell | 213/115 |
| 3,349,926 | 10/1967 | Cope | 213/20 |
| 3,371,563 | 3/1968 | Lallo | 81/176.2 |
| 4,181,048 | 1/1980 | Norton | 81/176.2 |
| 4,586,620 | 5/1986 | Andrews | 213/1 R |

*Primary Examiner*—Robert P. Olszewski
*Assistant Examiner*—S. Joseph Morano
*Attorney, Agent, or Firm*—Steven R. Scott

[57] ABSTRACT

A device adapted to assist in the alignment of a railroad car drawheads for coupling, said device having connecting means by which the handle thereof may be rigidly connected to, and serve as an extension of, the drawhead for the purpose of increasing leverage when rotating said drawhead on its pivot.

8 Claims, 3 Drawing Sheets

DRAWHEAD ALIGNMENT DEVICE

BACKGROUND OF THE INVENTION

1. Field of the Invention

This invention relates, in general, to implements designed to increase leverage in applying a twisting or turning force or pressure, such as wrenches. More specifically, it relates to tools and means designed to assist in aligning the couplings of railroad cars for connection of same with other railroad cars.

2. Summary of the Prior Art

Each railroad car is provided with pivot mounted couplings (known as "drawheads") designed to join with couplings of similar design on other railroad cars. The drawhead terminates in a "C" shaped assembly known as the "knuckle". the drawhead with its knuckle must be brought into alignment with the knuckle and drawhead of the railroad car with which it is to be joined before the two can be coupled. This requires railroad workers, operating alone or in groups, to force the drawheads into position by the exertion of physical strength. Unfortunately, due to wear, rust, binding of the metal parts and the sheer weight of the assemblies, this is a demanding task that endangers railroad workers. This results in numerous injuries to railroad workers each year, including a very large number of debilitating back injuries.

The hazards associated with working between railroad cars and the need to give physical assistance to workers in positioning drawheads for coupling operations have not resulted in the development of a multitude of devices intended to assist in this operation The two patents reviewed in this area differ significantly in their means of operation and design from the instant invention. Cope (U.S. Pat. No. 3,349,926) discloses a manually controlled fluid operated device for swinging the coupler into any desired position. In the embodiments discussed, a fluid powered piston contacts the side of the drawhead via the piston's shaft. The aforesaid piston and shaft lie in the horizontal plane swept by the drawhead as it rotates on its pivot. Thus, the shaft of the piston exerts a force on the drawhead when operated which can be used to move the drawhead into any desired position. While effective in theory, the Cope technique and apparatus have not been put into general use in the railroad industry. This undoubtedly due to the investment in equipment and installation required.

A much simpler means of approaching this problem is seen in the Railroad Car Coupler Alignment Device patented by Andrews (U.S. Pat. No. 4,586,620). The Andrews device consists of two end portions (both capable of being connected to the knuckles of opposing drawheads via the mating hole at the tIp of each knuckle) and a connecting cable. Once the end portions are connected to the two drawheads which are to be aligned, one of the cars must be moved apart from the other by the engineer. This causes the connecting cable to tighten and pull the two drawheads into substantial alignment. The device is then removed and the cars pushed back together for coupling. While the Andrews device has the virtues of simplicity of design and construction, its use requires the movement of an entire railroad car merely to effect the alignment of its drawhead. This can hardly be considered as a simple solution to the problem of assisting railroad workers in aligning drawheads for coupling.

SUMMARY OF THE INVENTION

The instant invention describes a simple, inexpensive, easily manufactured tool which provides railroad workers with added leverage when working with drawheads, decreasing their likelihood of injury and strain, while avoiding the difficulties inherent in the two designs previously discussed. It is comprised of a handle that acts as a lever arm and a headpiece which is designed to fit over and be attached to the tip of the knuckle. After the headpiece is placed over the tip of the knuckle, the tool forms a rigid extension of the drawhead to which it is attached. This extension provides railroad workers with a substantial increase in leverage as they seek to align drawheads, forcing the rotation of same around their respective pivots. In its preferred embodiment, the headpiece is provided with a cam lock pin which engages the opening typically found at the tip of each knuckle. This allows the device to retain its position aligned with the drawhead when force is applied to either side of the handle. Thus, pushing or pulling forces can be applied from either side of the drawhead without destabilizing the device.

DETAILED DESCRIPTION OF THE PREFERRED EMBODIMENT

Figure 1:
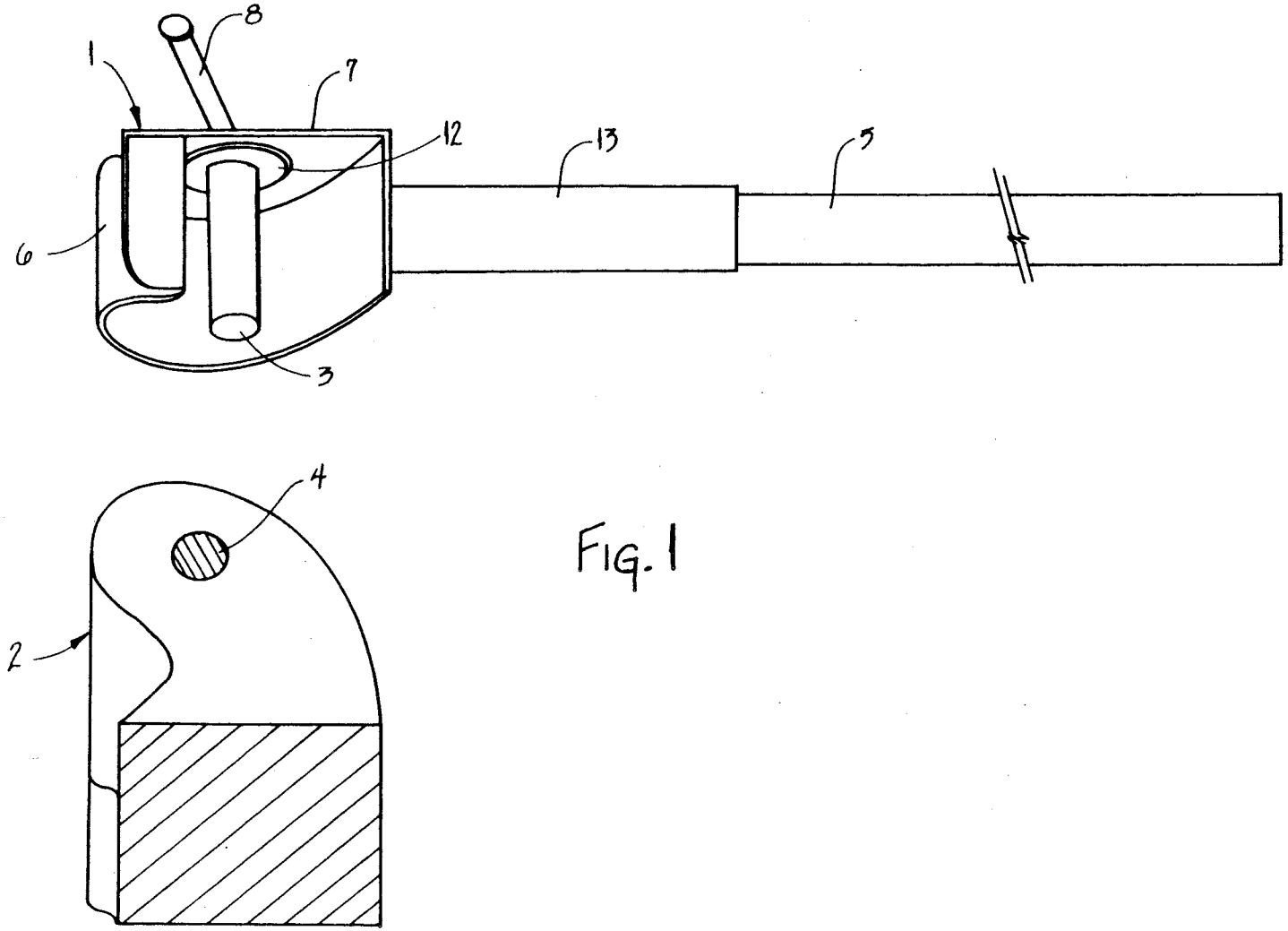
FIG. 1 gives a perspective view, from the open side thereof, of the instant invention positioned to engage the tip of a knuckle.

FIG. 1 shows the headpiece 1 of the instant invention positioned to engage the knuckle tip 2 of a railroad car's drawhead. From this position the device is engaged by merely sliding the headpiece 1 down over the knuckle tip 2 in such manner that the lower portion of the cam lock pin 3 is inserted into the mating hole 4 of the knuckle tip 2. When fully engaged, the side walls 6 and the top plate 7 of the headpiece 1, snugly conform to and enclosed the knuckle tip 2. In this position, pressure can be exerted on the handle 5 to swing the device (and the drawhead with which it is engaged) in either a clockwise or a counterclockwise direction (as seen from above) without dislodging the device from its engaged position. This provides substantial additional torque to railroad workers as they seek to force rotation of the drawhead on its pivot into the desired position.

Figure 2:
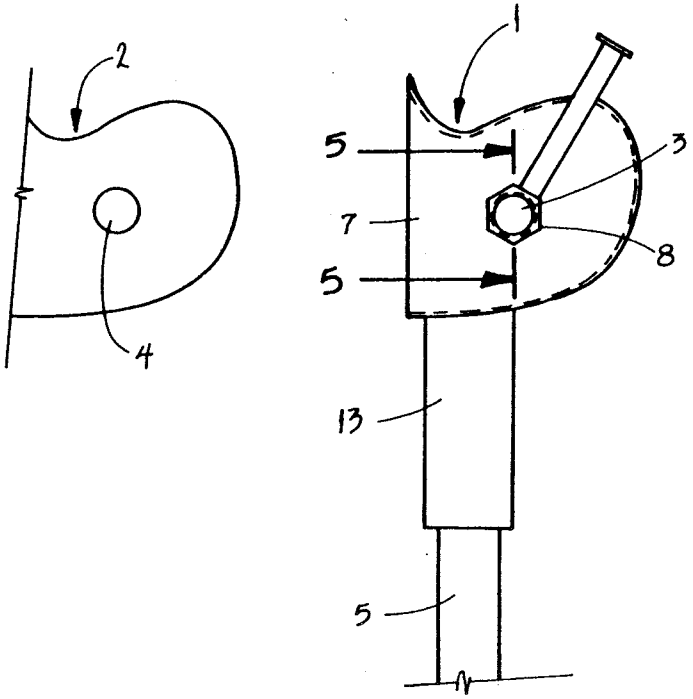
FIG. 2 illustrates the general shape and configuration of the knuckle tip of a railroad car's drawhead and the conforming shape of the headpiece of this invention, both as seen from above.

FIG. 2 as well as FIG. 1 illustrate the fact that the headpiece 1 of this device has a shape that conforms to that of the knuckle tip 2. However, as will be explained in more detail below, this shape is not absolutely necessary to the function of this invention. Other configurations are possible without exceeding the scope of this invention. Nonetheless, the shape illustrated has been found to be the most efficient configuration and is, therefore, set forth as the preferred embodiment of the instant invention.

Figure 3:
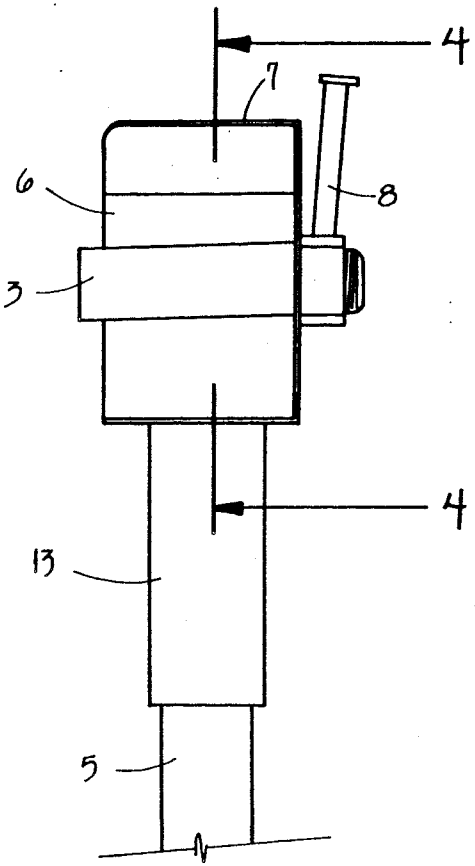
FIG. 3 provides a side view of the headpiece of this invention as seen from the open side thereof.

FIG. 3 provides a side view of the headpiece 1 from the open side, giving an alternate view of side walls 6, top plate 7, cam lock pin 3 and levered nut 8.

Figure 4:
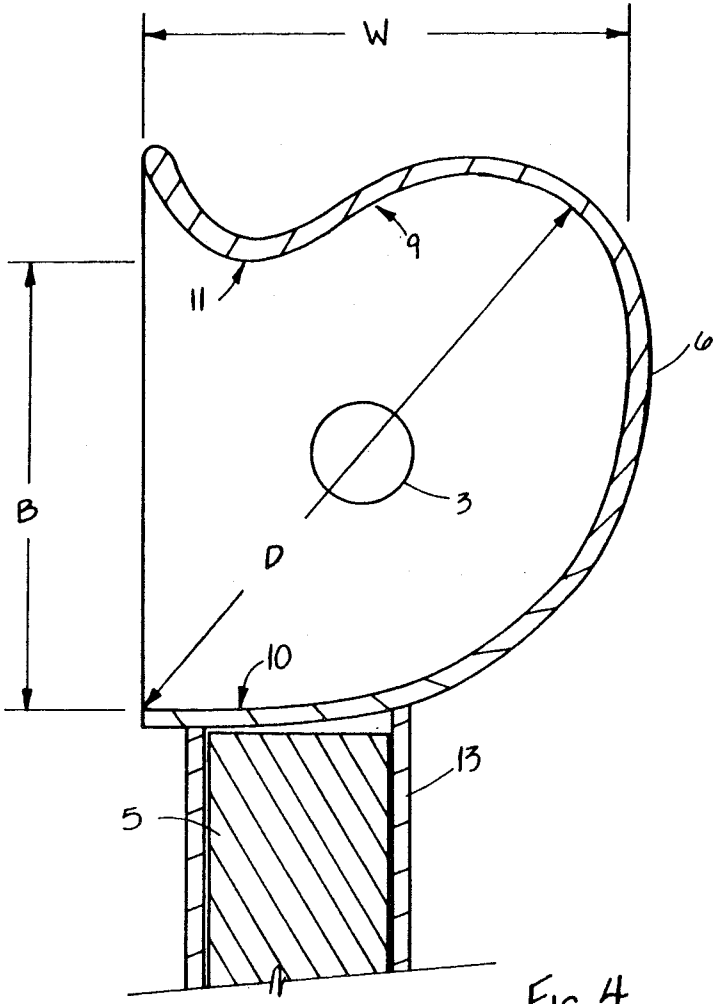
FIG. 4 provides a cross-sectional view of the headpiece of this invention, the cross-section being taken along the line 4—4 of FIG. 3.

FIG. 4 provides insight into the means by which the headpiece 1 is firmly and rigidly engaged on the knuckle tip 2 once placed in position. In referring to FIG. 4, it will be noted that clockwise rotation of the headpiece 1 about the cam lock pin 3 (caused by pressure in said direction applied to the handle 5) is not possible as such rotation is blocked by contact between the side walls 6 or the headpiece 1 and the knuckle tip 2 in those regions generally referenced as the first interface 9, and/or the second interface 10. Likewise, counter-clockwise rotation around the cam lock pin 3 is not possible due to contact between the side walls 6 and the knuckle tip 2 in the region generally referenced as the third interface 11. As rotation is not possible in either direction around the cam lock pin 3, the drawhead alignment device disclosed herein acts as a rigid extension of the drawhead. Thus, torque that would normally be applied at or near the knuckle of the drawhead in seeking to rotate same on its pivot can now be applied at the end of the lengthened lever arm now formed by the drawhead alignment device in rigid connection with the drawhead. This added length substantially increases the leverage available to railroad workers, decreasing physical strain and thereby helping to avoid physical injury.

FIG. 4 also illustrates the interior dimensions of the headpiece. As denoted therein, the maximum interior width of the headpiece 1, indicated by "W", is approximately three and one-half (3½) inches; the distance along the breadth labelled "B" is approximately three (3) inches; and the distance along the diagonal labelled "D" is approximately four and three-quarters (4¾) inches. The cam lock pin 3 should not be more than one (1) inch wide in order to fit the mating hole 4, and is centered approximately at the half-way point of diagonal "D".

Figure 5:
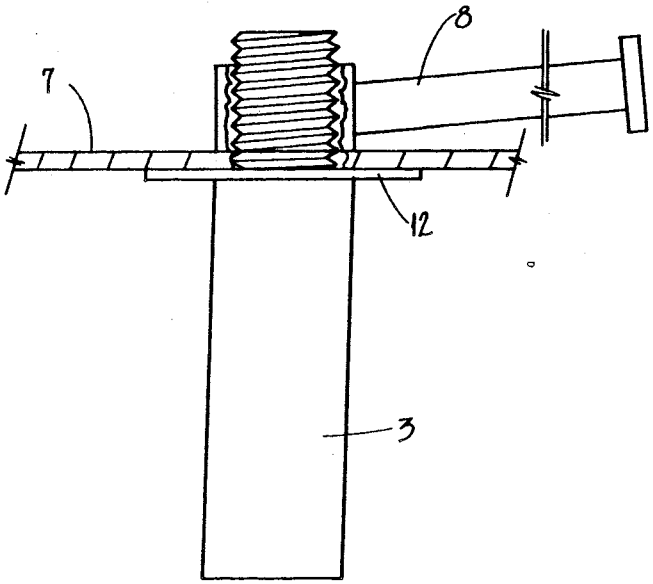
FIG. 5 gives a cross-sectional view of the cam lock pin with levered nut engaged in a portion of the top plate of the headpiece, the cross-section being taken along the line 5—5 of FIG. 2.

FIG. 5 illustrates features of the cam lock pin 3 that allow the drawhead alignment device to function when used with knuckles and drawheads varying slightly in manufacture and in the position of the mating hole 4. These slight variations make rigid immovable attachment of the cam lock pin 3 to the top plate 7 inadvisable due to the possibility that the headpiece 1 will not fit and function when used on some manufactures. However, it has been determined that the modest variability allowed by off-setting the center of the lower portion of the cam lock pin 3 from the threaded portion thereof by approximately one-eighth (1/8) inch substantially improves the ability of the described device to function with all manufactures of drawheads. When necessary adjustments have been made allowing the headpiece 1 to engage the knuckle tip 2, the levered nut 8 may be tightened on the threaded portion of the cam lock pin 3, bringing the flange 12 of the cam lock pin 3 into frictional contact with the top plate 7, thereby rendering the cam lock pin 3 immovable relative to the top plate 7.

In production of this invention it has been found that one-quarter (¼) inch steel is suitable for construction of the side walls 6 and the top plate 7. The handle sheath 13 can be suitably produced from a convenient length of steel pipe with interior dimensions sufficient to accommodate a handle of approximately one (1) inch diameter. The handle 5 may itself be a fiberglass or wood handle of the type that is readily available from many manufacturers. In use it has been found that a handle length of approximately three (3) feet is suitable for the purposes for which the instant invention is designed. However, in all of these dimensions and specifications as in all other aspects of this invention, wide variation is possible without exceeding the scope of this invention.

Further, as previously noted, it is possible to manufacture embodiments of this invention that would function in equivalent fashion and would not utilize a headpiece shaped to conform to the knuckle tip. This could, for example, be done by producing a device having: (1) a rod or pin designed to engage the mating hole of the knuckle with (2) only those portions of the side walls necessary to contact the knuckle tip at interfaces 9, 10 and 11 rigidly positioned with respect to each other via (3) a top plate or other means. A device of this or similar design would provide the same type of gripping and binding forces when engaged on the knuckle tip. It and any similar device utilizing a connecting means whereby a handle may be rigidly connected to, and serve as an extension of the drawhead for the purpose of increasing leverage when rotating said drawhead on its pivot are, however subsumed under the description and claims set forth herein.

I claim:

1. A Railroad Drawhead Alignment Device, comprising:

a first rigid linear element capable of being used as a lever arm; and

A connecting means whereby said first rigid linear element may be rigidly connected to, and serve as a substantially linear extension of, the drawhead of a railroad car, said connecting means including a plurality of vertical linear elements perpendicular to the first rigid linear element, said vertical linear elements being positioned in such manner as to proximately contact, along the length of each, the sides of a railroad car's knuckle tip when the Railroad Drawhead Alignment Device is connected thereto via its connecting means.

2. A Railroad Drawhead Alignment Device, as specified in claim 1, further comprising: A second rigid linear element perpendicular to the first rigid linear element, said second rigid linear element being of a size permitting its insertion into the mating hole of a railroad car's knuckle tip.

3. A Railroad Drawhead Alignment Device, as specified in claim 1 wherein said plurality of vertical linear elements perpendicular to the first rigid linear element form a continuous vertical element substantially enclosing and snugly conforming to the sides of the railroad car's knuckle tip when the Railroad Drawhead Alignment Device is connected thereto via its connecting means.

4. A Railroad Drawhead Alignment Device, as specified in claim 2, wherein said plurality of vertical linear elements perpendicular to the first rigid linear element form a continuous vertical element substantially enclosing and snugly conforming to the sides of the railroad car's knuckle tip when the Railroad Drawhead Alignment Device is connected thereto via its connecting means.

5. A Railroad Drawhead Alignment Device, as specified in claim 2, wherein said second rigid linear element is capable of linear non-rotational movement in directions perpendicular to the axis thereof for the purpose of adjusting the location of said second rigid linear element relative to other portions of the connecting means for insertion into the mating hole of a railroad car's knuckle tip.

6. A Railroad Drawhead Alignment Device, as specified in claim 5, wherein said second rigid linear element is provided with means by which it may be non-permanently stabilized in a desired position relative to other portions of the connecting means.

7. A Railroad Drawhead Alignment Device as specified in claim 4, wherein said second rigid linear element is capable of linear non-rotational movement in directions perpendicular to the axis thereof for the purpose of adjusting the location of said second rigid linear element relative to other portions of the connecting means for insertion into the mating hole of a railroad car's knuckle tip.

8. A Railroad Drawhead Alignment Device, as specified in claim 5, wherein said second rigid linear element is provided with means by which it may be non-permanently stabilized in a desired position relative to other portions of the connecting means.

* * * * *